US007287775B2

(12) United States Patent
Walker et al.

(10) Patent No.: US 7,287,775 B2
(45) Date of Patent: Oct. 30, 2007

(54) ADJUSTABLE SKI SKIN ATTACHMENT DEVICE

(75) Inventors: Ben Walker, Draper, UT (US); David Narajowski, Heber City, UT (US); David Mellon, Park City, UT (US); Thomas Laakso, Park City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 372 days.

(21) Appl. No.: 10/969,396

(22) Filed: Oct. 20, 2004

(65) Prior Publication Data

US 2006/0082103 A1 Apr. 20, 2006

Related U.S. Application Data

(60) Provisional application No. 60/525,129, filed on Nov. 25, 2003.

(51) Int. Cl.
*B62K 13/06* (2006.01)

(52) U.S. Cl. ..... 280/604; 280/601; 280/896.7; 280/400; 280/43; 280/85

(58) Field of Classification Search ..... 280/604, 280/601, 896.7, 400, 43, 85; 29/896.7; 411/400; 403/43; 59/85; 24/569, 525
See application file for complete search history.

(56) References Cited

U.S. PATENT DOCUMENTS

| | | | | | |
|---|---|---|---|---|---|
| 333,095 | A | * | 12/1885 | Munro | 59/85 |
| 1,454,335 | A | * | 5/1923 | Prendergast | 59/85 |
| 2,347,088 | A | * | 4/1944 | Dock | 59/85 |
| 2,358,213 | A | * | 9/1944 | Courage | 280/604 |
| 2,524,935 | A | * | 10/1950 | Skold | 59/85 |
| 2,621,471 | A | * | 12/1952 | Dock | 59/85 |
| 4,177,869 | A | * | 12/1979 | Crabiel | 180/6.58 |

* cited by examiner

*Primary Examiner*—Christopher P. Ellis
*Assistant Examiner*—Cynthia F. Collado
(74) *Attorney, Agent, or Firm*—Trent H. Baker; Baker & Associates PLLC

(57) ABSTRACT

The present invention relates to an adjustable ski skin attachment device that can be used to efficiently attach a skin to a ski or snowboard. In accordance with the present invention, an adjustable ski skin attachment device includes two threaded members, a coupler, and a cover. The two threaded members are threaded in reverse directions from one another. The coupler includes two receiving portions with reverse threaded receiving portions such that when the threaded members are inserted into the two receiving portions and the coupler is rotated in one direction, the two threaded members move closer together. And when the coupler is rotated in the opposite direction, the two threaded members move away from one another. The cover is positioned over the two threaded members opposite the coupler. Unlike conventional skin attachment devices, the adjustable ski skin attachment device in accordance with the present invention can be adjusted to fit over a wide variety of widths and tip shapes.

29 Claims, 4 Drawing Sheets

ADJUSTABLE SKI SKIN ATTACHMENT DEVICE

RELATED APPLICATIONS

This application claims priority to U.S. Provisional Application Ser. No. 60/525,129, filed Nov. 25, 2003, entitled "ADJUSTABLE SKI SKIN ATTACHMENT DEVICE".

TECHNICAL FIELD

The present invention relates to ski devices and more particularly to an adjustable ski skin attachment device.

BACKGROUND

Skins are long strips of material that are positioned on the underside of a ski or snowboard for the purpose of ascending snow-covered slopes. Skins can be composed of any friction inducing material including felt, rubber, fur, etc. Skins are generally designed to increase friction between the snow and the ski or snowboard. By increasing the friction on the bottom of the ski or snowboard, a user can slide or skin up a snow covered slope without sliding back down in the process. The skins can then be removed to allow the user to ski or snowboard down the slope without interfering with the downhill performance of the skis or snowboard.

The process of skinning up a steep snow-covered slope involves a tremendous amount of physical work. Various inefficiencies often arise if the skins are not properly attached to the bottom of the skis or snowboard. For example, if a skin becomes detached or misaligned with a ski or snowboard, the user will be forced to stop and fix the problem or exert even more physical effort to ascend the slope. Therefore, it is desirable to incorporate a reliable skin attachment system with a pair of skins such that a user can efficiently ascend a snow-covered slope without problems or complications.

Conventional skin attachment systems involve temporarily affixing the skins to the skis or snowboard with a sticky material such as glue. The particular type of glue must remain sticky at low temperatures and somewhat moist conditions. In addition to affixing the skins to the skis or snowboard, it is generally advisable to also attach the skins to one or both ends of the skis or snowboard to ensure that the skins do not bend or fold. The skins are attached to the skis or snowboard with some form of skin attachment device. The skin attachment device may be permanently stitched onto one or both ends of the skins or require the skins to be folded onto them selves for attachment. Conventionally, a front end skin attachment device is a substantially fixed non-adjustable shape. The front end skin attachment device is simply looped over the front tip of the ski or snowboard. Rear skin attachment devices generally involve some form of stretching mechanism in addition to an attachment device. For example, a conventional rear skin attachment device could involve attaching a rubber strip with a hook to the rear portion of the skin. The hook and rubber strip could be stretched to the back end of the ski or snowboard and hooked over a flat surface thereby effectively stretching the skin and securing it to the rear end of the ski or snowboard.

Unfortunately, as skis and snowboards have evolved, conventional skin attachment devices are no longer effective at attaching skins to modern skis and snowboards. Modern skis and snowboards come in a wide variety of widths and tip shapes. Some skis and snowboards are extremely wide for powder snow conditions while others are relatively narrow for hard pack snow conditions. Many modern skis and snowboards have evolved to include curved tips on both the front and rear to allow users to travel in either direction. Skis or snowboards may also be equipped with split tail ends for powder snow condition performance.

In addition, it has been discovered that there is an optimal position for skin attachment devices to secure the skin to the front or rear end of a ski or snowboard. The optimal position ensures a reliable attachment but does not impede efficient ascension. Skis and snowboards almost always include an upward curved section at one or both ends of the skis or snowboard. If the skin attachment device is positioned too close to the actual tip of the skis or snowboard, the skin may accidentally detach from the ski or snowboard forcing the user to stop and reattach it. Likewise, if the skin attachment device is positioned too far away from the actual tip and beyond the curved portion, the skin attachment device will act like a snowplow and significantly impede a user's ability to efficiently ascend up a slope. Because of the wide variety of widths and tip shapes, it becomes almost impossible to manufacture a single skin attachment device that can be positioned in the optimal position for attaching a skin to any ski or snowboard.

SUMMARY

As discussed above, there are a wide variety of ski and snowboard widths and tip shapes. Since the width and tip shape of the ski or snowboard dramatically affects the ability to position a skin attachment device in the optimal position, it would almost be necessary to have a customized skin attachment device for every ski or snowboard. Because of the high cost in manufacturing a customized skin attachment device for every ski or snowboard, there is a need in the industry for a skin attachment device that can conform to the size and shape of a wide variety of skis and snowboards. The proposed adjustable ski skin attachment device should be easy to manufacture and be able to be positioned in the optimal position on a wide variety of skis and snowboards.

The present invention relates to an adjustable ski skin attachment device that can be used to efficiently attach a skin to a ski or snowboard. In accordance with the present invention, an adjustable ski skin attachment device includes two threaded members, a coupler, and a cover. The two threaded members are threaded in reverse directions from one another. The coupler includes two receiving portions with reverse threaded receiving portions such that when the threaded members are inserted into the two receiving portions and the coupler is rotated in one direction, the two threaded members move closer together. And when the coupler is rotated in the opposite direction, the two threaded members move away from one another. The cover is positioned over the two threaded members opposite the coupler. Unlike conventional skin attachment devices, the adjustable ski skin attachment device in accordance with the present invention can be adjusted to fit over a wide variety of widths and tip shapes.

Alternatively, the two threaded members and the two receiving portions could be threaded in the same direction. In this alternative embodiment, the coupler could not simply be rotated to adjust the distance between the two threaded members. Rather, the cover would need to be removed to allow the two threaded members to independently rotate with respect to the coupler. However, the threaded members are still capable of interconnecting with one another to form an adjustable shape that is capable of encircling a wide variety of skis or snowboards.

In another alternative embodiment, the adjustable ski skin attachment device comprises a coupler member and a threaded member. The coupler member includes a receiving portion and a cover end. Likewise, the threaded member includes a threaded end and a cover end. The threaded end of the threaded member and the receiving portion of the coupler member are threaded to match one another in a male/female configuration. Either the threaded end or the receiving portion may be threaded in a male configuration and vice versa. Therefore, the threaded member and coupler member are capable of interconnection with one another to form an adjustable shape that is capable of encircling the tip of a wide variety of skis and snowboards.

In yet another alternative embodiment, the adjustable skin attachment device comprises two non-threaded members. The two non-threaded members may be configured to adjustably interlock with one another or could be configured to adjustably interlock with a coupler. Various adjustable interlocking systems may be used and remain consistent with the present invention. For example, a rod and socket or a ball and socket. In addition, the adjustable interlocking systems could include specific shapes that allow the two non-threaded members to snap into a particular configuration with one another.

The foregoing and other features, utilities, and advantages of the invention will be apparent from the following detailed description of the invention with reference to the accompanying drawings.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

Reference will now be made to the drawings to describe presently preferred embodiments of the invention. It is to be understood that the drawings are diagrammatic and schematic representations of the presently preferred embodiments, and are not limiting of the present invention, nor are they necessarily drawn to scale.

The present invention relates to an adjustable ski skin attachment device that can be used to efficiently attach a skin to a ski or snowboard. In accordance with the present invention, an adjustable ski skin attachment device includes two threaded members, a coupler, and a cover. The two threaded members are threaded in reverse directions from one another. The coupler includes two receiving portions with reverse threaded receiving portions such that when the threaded members are inserted into the two receiving portions and the coupler is rotated in one direction, the two threaded members move closer together. And when the coupler is rotated in the opposite direction, the two threaded members move away from one another. The cover is positioned over the two threaded members opposite the coupler. Unlike conventional skin attachment devices, the adjustable ski skin attachment device in accordance with the present invention can be adjusted to fit over a wide variety of widths and tip shapes. Also, while embodiments of the present invention are described in the context of a connection system between a skin and a ski or snowboard, it will be appreciated that the teachings of the present invention are applicable to other applications as well.

Figure 1:
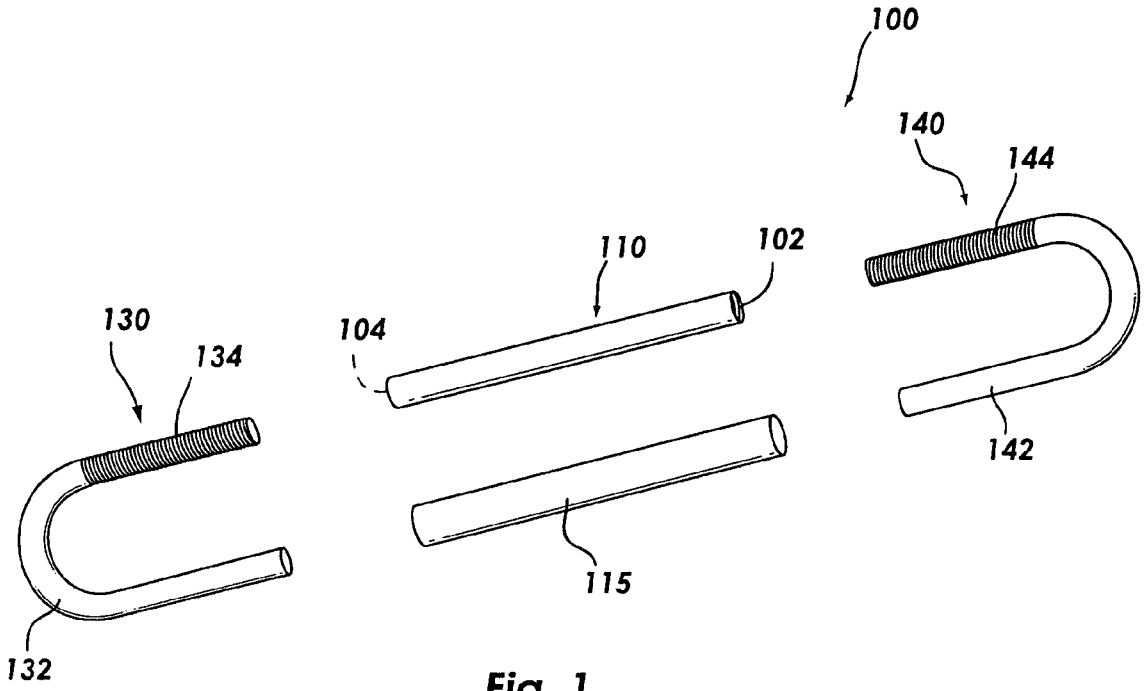
FIG. 1 illustrates an exploded view of one embodiment of an adjustable ski skin attachment device according to the present invention.

Reference is initially made to FIG. 1, which illustrates an exploded view of one embodiment of an adjustable ski skin attachment device according to the present invention. The adjustable ski skin attachment device is designated generally at 100. The adjustable ski skin attachment device comprises two threaded members 130, 140, a coupler 110, and a cover 115. The two threaded members 130, 140 are each substantially U-shaped such that the two ends are positioned near one another. The term U-shaped is meant to broadly describe any shape in which the two ends are positioned near one another. For example, a V-shape, a W-shape, or a three-sided rectangle would fall within this definition. The threaded members 130, 140 each further include a threaded end 134, 144 and a cover end 132, 142. The threaded ends 134, 144 are spirally threaded opposite one another. Therefore, if the threaded end 134 is right spirally threaded, the threaded end 144 on the opposite threaded member 140 will be left spirally threaded, and vice versa. Alternatively, the threaded members 130, 140 could be threaded in the same direction as one another. Although the illustrated embodiment shows a fine threading on both the threaded ends 134, 144, it will be appreciated that any type of threading may be used on the threaded ends 134, 144 including but not limited to coarse threading, corkscrew threading, notch threading, etc. Likewise, although the illustrated embodiment illustrates the threads extending a particular distance up each of the threaded members, the threads may cover the entire threaded members 130, 140 or any variant in-between. The two threaded members are composed of a substantially rigid material such as metal or hard plastic.

The coupler 110 is a substantially cylindrically shaped object including two reverse threaded receiving portions 102, 104. The reverse threaded receiving portions 102, 104 are disposed on opposite sides of the coupler 110. The coupler is composed of a substantially rigid material such as metal or hard plastic. The receiving portions 102, 104 are shaped and threaded to match the threading on the threaded ends 134, 144 of the two threaded members 130, 140. Therefore, if the threaded ends 134, 144 are finely threaded, the receiving portions 102, 104 will also be finely threaded to allow the threaded ends 134, 144 to properly couple with the receiving portions. When assembled, the threaded members 130, 140 are each coupled to the coupler 110 via the threaded ends 134, 144 and the receiving portions 104, 102, respectively. If the threading on the two receiving portions 102, 104 and the two threaded members 130, 140 is opposite one another, the threaded members 130, 140 can be moved closer together or further apart by simply rotating the coupler 110. For example, if the threaded member 140 and receiving portion 102 are right spirally threaded and the threaded member 130 and receiving portion 104 are left spirally threaded, then rotating the coupler to the right (from the perspective of being closest to threaded member 130) will cause the threaded members 130, 140 to move closer together. And rotating the coupler to the left (from the same perspective) will cause the threaded members 130, 140 to move further apart from one another. Therefore, in this manner, the spacing between the two threaded members 130, 140 can accurately be adjusted by simply rotating the coupler 110. However, if the threading on the receiving portions 104, 102 and the two threaded members 130, 140 is the same, the threaded members cannot be moved closer or further from one another by rotating the coupler 110. If the threading is the same on both sides, rotating the coupler will cause one threaded member to move closer while the other is moved further away from the coupler 110. Therefore, to adjust the distance between the threaded members 130, 140, in an embodiment with the same threading on either side, the threaded members 130, 140 must be independently rotated with respect to the coupler 110. In addition, the coupler could be incorporated or integrated with one of the threaded members 130, 140 for the purpose of minimizing the total number of parts. Although FIG. 1 illustrates the receiving portions 104, 102 on the coupler 110 in a female threaded configuration and the threaded ends 134, 144 on the threaded members 130, 140 in a male threaded configuration, it will be appreciated that the opposite may be true. For example, the threaded ends 134, 144 may be threaded in a female configuration and the receiving portions 104, 102 may be threaded in a male configuration.

The cover 115 is a substantially tubular shaped object that is sized to fit over the cover ends 132, 142 of the threaded members 130, 140. The cover 115 ensures that the threaded members 130, 140 remain aligned with one another while rotating the coupler 110. The term tubular is broadly defined to be any external shape with an internal hole or recess. Although the cover 115 is illustrated in a substantially linear shape, the cover 115 may be shaped in any manner to cover the two cover ends 132, 142 of the threaded members 130, 140 and remain consistent with the present invention. For example, if the cover ends 132, 142 flare away from the coupler 110, the cover 115 may be substantially V-shaped to properly cover the cover ends 132, 142. Various shapes may be necessary to fit over protrusions on skis or snowboards. Alternatively, the cover 115 could be permanently coupled or incorporated into one of the cover ends 132, 142 of the threaded members 130, 140 such that one of the cover ends 132, 142 is able to slide within the other. The cover 115 is composed of a substantially flexible material such as rubber or plastic.

Figure 2:
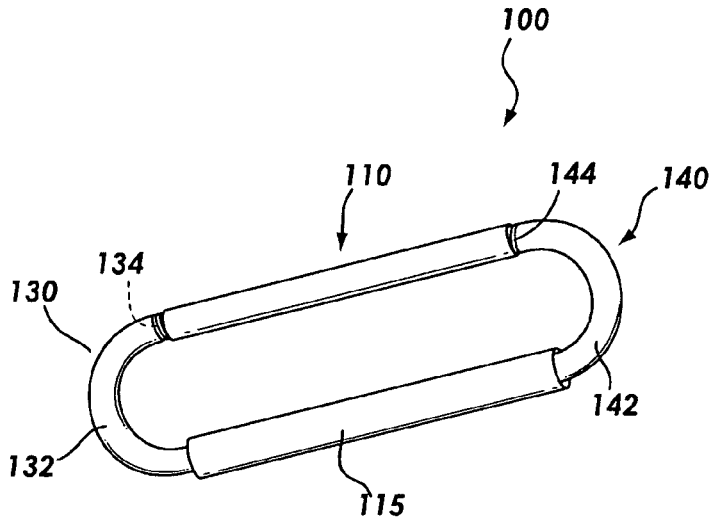
FIG. 2 illustrates a perspective view of the assembled adjustable ski skin attachment device shown in FIG. 1.

Reference is next made to FIG. 2, which illustrates a perspective view of the assembled adjustable ski skin attachment device shown in FIG. 1. The threaded members 130, 140 are each coupled to the coupler 110 via the receiving portions (not shown) and the threaded ends 134, 144. The cover 115 extends over the cover ends 132, 142 of the threaded members 130, 140. Alternatively, the cover 115 could bend and extend all the way over the exposed portions of both the cover ends 132, 142 and the threaded ends 134, 144.

Figure 3:
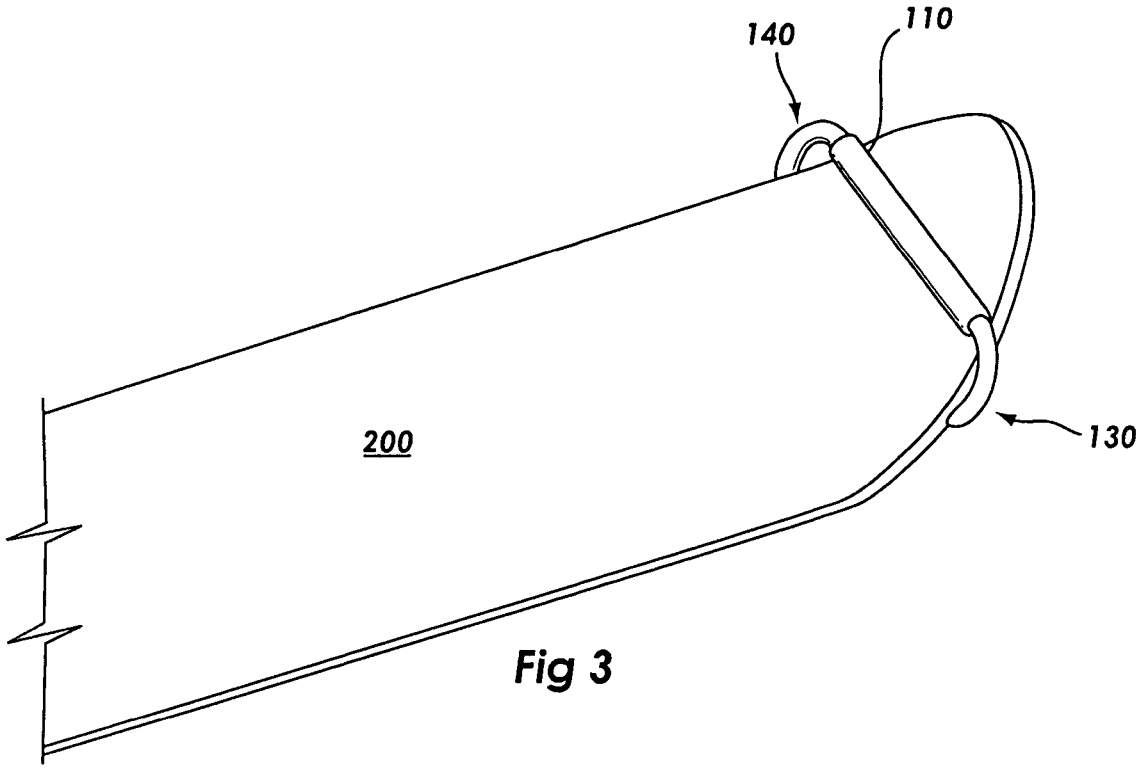
FIG. 3 illustrates a perspective view of the adjustable ski skin attachment device illustrated in FIG. 1 optimally positioned over a relatively narrow ski.

Reference is next made to FIG. 3, which illustrates a perspective view of the adjustable ski skin attachment device illustrated in FIG. 1 optimally positioned over a relatively narrow ski 200. The term ski or ski device is meant to broadly describe any object on which a skin could be mounted. For example, this definition would include a cross-country traditional ski, a skate ski, an alpine ski, a split-tip ski, half of a split-board, a track on a sleigh, a track on a snowmobile, etc. The adjustable ski skin attachment device is positioned in what is called the optimal position on the ski. The optimal position is a position on the ski that allows the adjustable ski skin attachment device to be securely attached to the ski and does not significantly impede the ability of a user to ascend a snow covered slope. Almost all skis contain a ramped section at the tip as shown in FIG. 3. It is desirable to position the adjustable ski skin attachment device as far away from the actual tip as possible to securely attach it to the ski. However, if the adjustable ski skin attachment device is positioned too far away from the tip, it will not be below the ramped section of the ski and will be located below the flat portion of the ski. If the adjustable ski skin attachment device is positioned below the flat portion of the ski, it will act as a snow plow and impede a user's ability to ascend a snow covered slope. Therefore, the optimal position of the adjustable ski skin attachment device is shown in FIG. 3.

Figure 4:
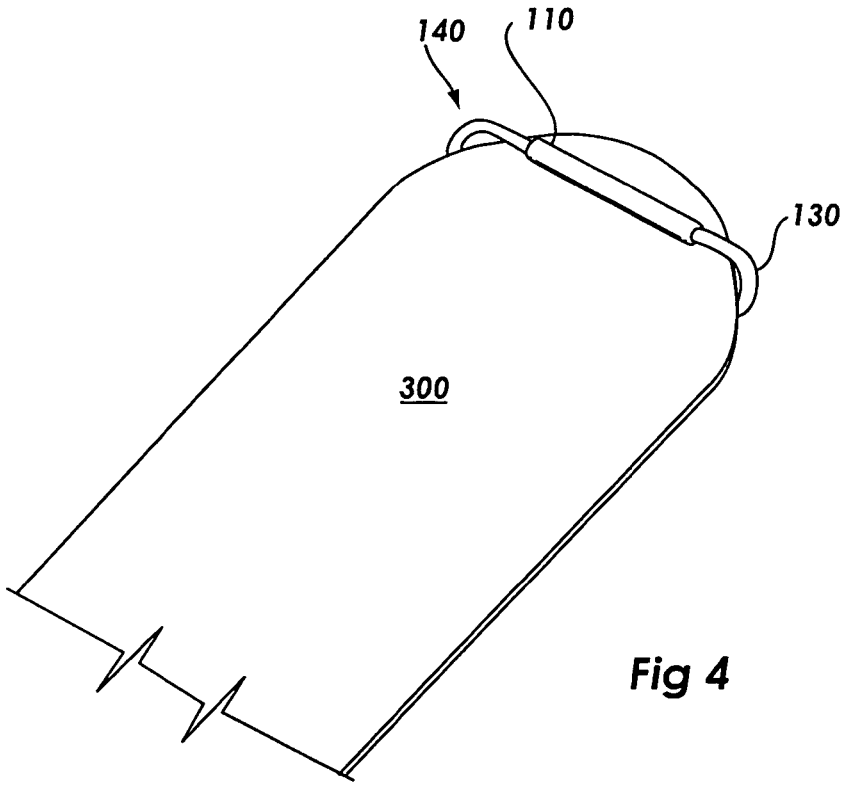
FIG. 4 illustrates a perspective view of the adjustable ski skin attachment device illustrated in FIG. 1 optimally positioned over a relatively wide ski.

Reference is next made to FIG. 4, which illustrates a perspective view of the adjustable ski skin attachment device illustrated in FIG. 1 optimally positioned over a relatively wide ski 300. The same adjustable ski skin attachment device 100 can be positioned over the relatively wide ski 300 because of the ability to adjust the distance between the threaded members 130, 140. After a user couples the adjustable ski skin attachment device 100 to the skin, the user can slide the adjustable ski skin attachment device over the tip of the ski 300. If the adjustable ski skin attachment device does not initially slide into the optimal position on the ski, the coupler 110 can be rotated to change the distance between the threaded members 130, 140. This process therefore allows a user to accurately position the adjustable ski skin attachment device in the optimal position of a wide variety of skis.

Figure 5:
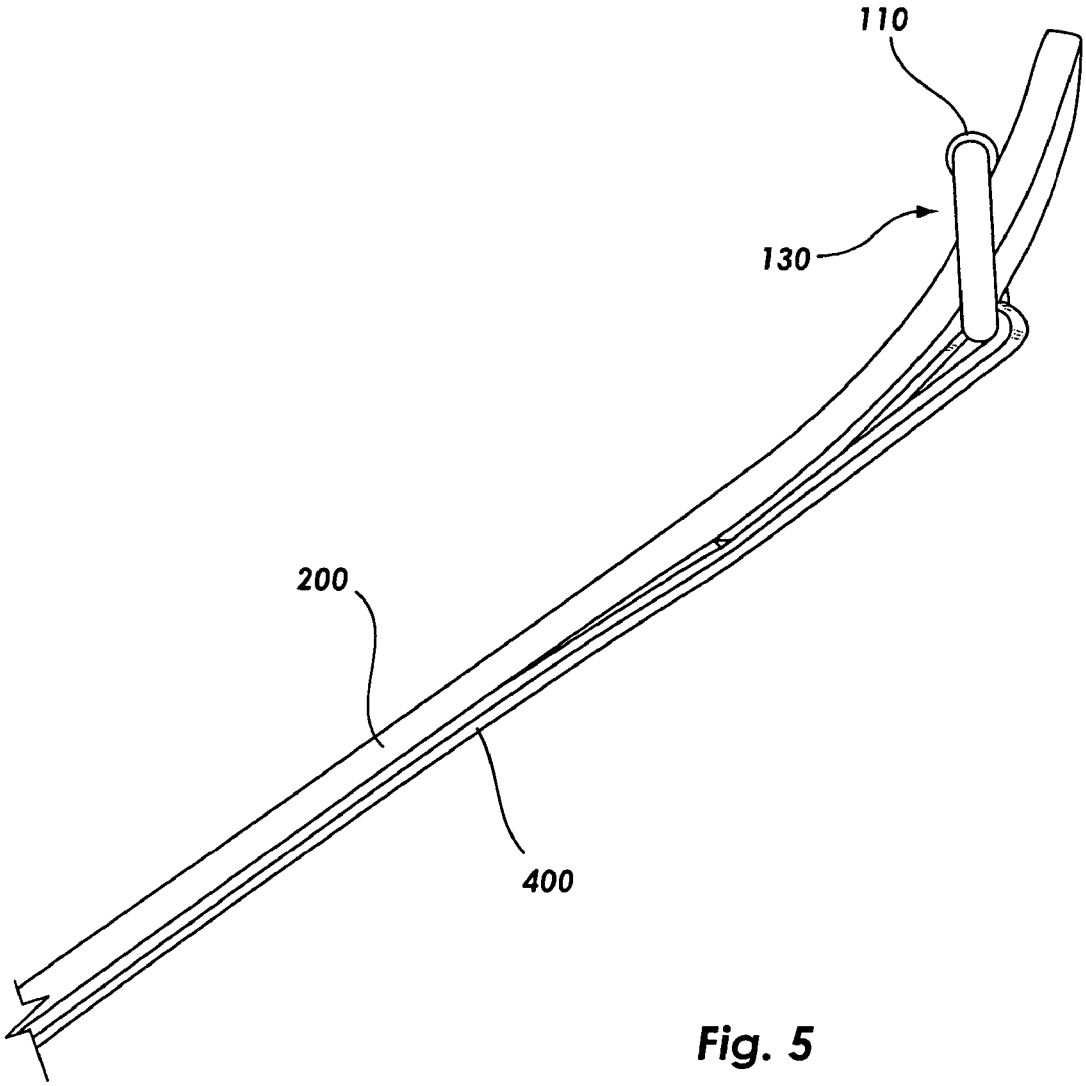
FIG. 5 illustrates a profile view of the adjustable ski skin attachment device illustrated in FIG. 1 optimally positioned over a ski.

Reference is next made to FIG. 5, which illustrates a profile view of the adjustable ski skin attachment device illustrated in FIG. 1 optimally positioned over the narrow ski 200 as shown in FIG. 2. The adjustable ski skin attachment device 100 is coupled to the skin 400 by inserting a portion of the skin through the adjustable ski skin attachment device and affixing the inserted portion to the remainder of the skin that was not inserted through the adjustable ski skin attachment device 100. Alternatively, the adjustable ski skin attachment device 100 could be coupled to the skin 400 by folding a piece of material through the adjustable ski skin attachment device 100 and onto either side of one of the ends of the skin 400 and then stitching the piece of material to the skin 400. The skin 400 is attached to the cover 115 (not shown) side of the adjustable ski skin attachment device to leave the coupler 110 free for adjustment purposes. FIG. 5 also shows how the adjustable ski skin attachment device 100 is optimally positioned on the furthest possible position on the ramped portion from the tip of the ski 200.

Figure 6:
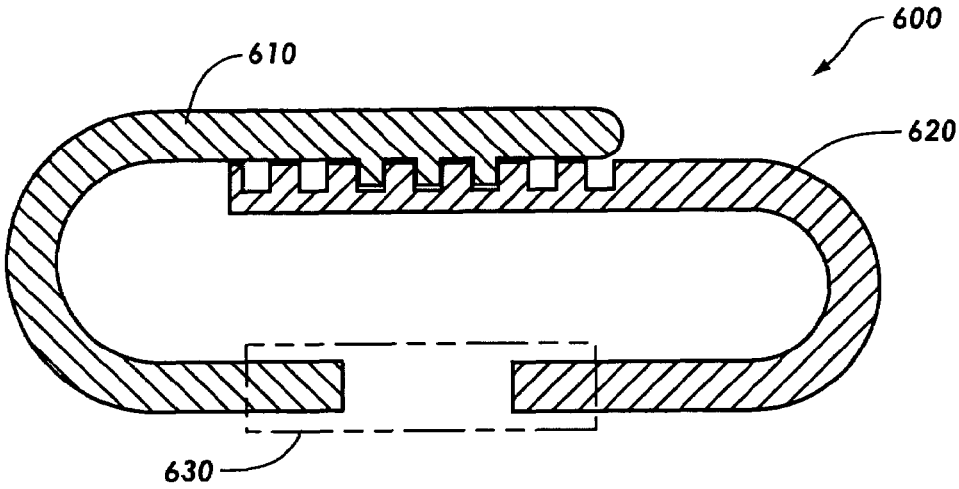
FIG. 6 illustrates an alternative embodiment of an adjustable skin attachment device wherein the two members are non-threaded are adjustably coupled to one another via a hooking system.

Reference is next made to FIG. 6, which illustrates an alternative embodiment of an adjustable skin attachment device wherein the two members are non-threaded and are adjustably coupled to one another via a hooking system. The adjustable skin attachment device is designated generally at 600 and comprises a first member 610 and a second member 620. As shown, the first member 610 is shaped to adjustably interlock with the second member 620 thereby eliminating the need for a coupler. The distance between the members 610, 620 may be adjusted by interlocking different male and female connectors on the first and second members 610, 620. In addition, an optional cover 630 may be extended over the non-coupled sides of the attachment device.

Figure 7:
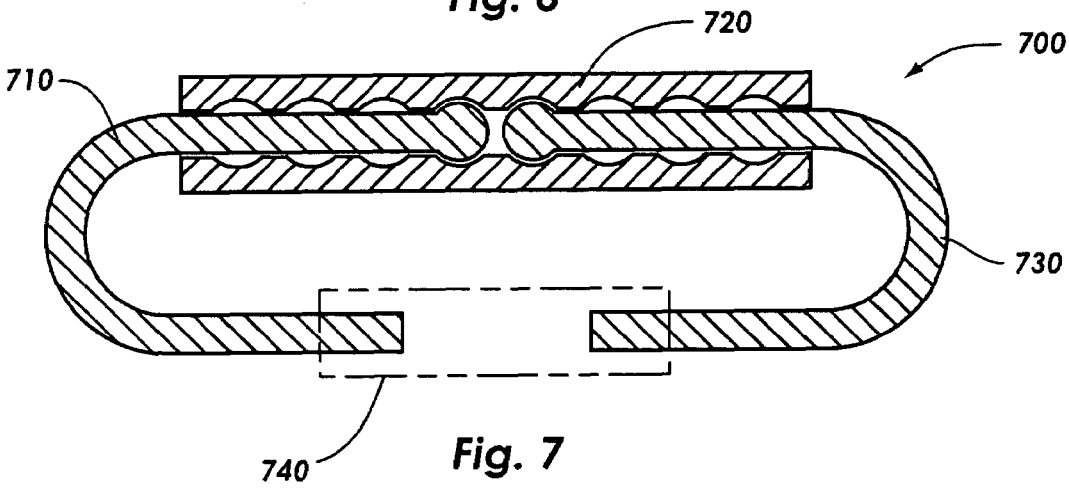
FIG. 7 illustrates yet another alternative embodiment of an adjustable skin attachment device wherein the two members are non-threaded and are adjustably coupled to a coupler via a ball and socket system.

Reference is next made to FIG. 7, which illustrates yet another alternative embodiment of an adjustable skin attachment device wherein the two members are non-threaded and are adjustably coupled to a coupler via a ball and socket system. The adjustable skin attachment device is designated generally at 700 and comprises a first member 710, a coupler 720, and a second member 730. The first and second members 710, 730 are adjustably coupled to the coupler 720 with a ball and socket configuration. The coupler is illustrated in a semi-cutaway manner to illustrate the adjustable coupling mechanism. The distance between the members 710, 730 may be adjusted by clamping the coupler over the ball ends of the members 710, 730 at a different distance. In addition, an optional cover 740 may be extended over the non-coupled sides of the attachment device.

Figure 8:
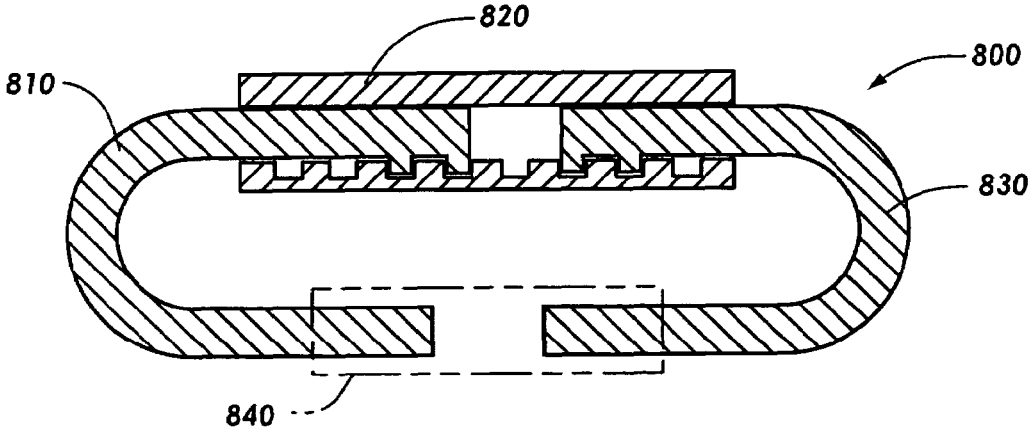
FIG. 8 illustrates yet another alternative embodiment of an adjustable skin attachment device wherein the two members are non-threaded and are adjustably coupled to a coupler via a hook system.

Reference is next made to FIG. 8, which illustrates yet another alternative embodiment of an adjustable skin attachment device wherein the two members are non-threaded and are adjustably coupled to a coupler via a hook system. The adjustable skin attachment device is designated generally at 800 and comprises a first member 810, a coupler 820, and a second member 830. The first and second members 810, 830 are adjustably coupled to the coupler 820 with a hook and socket configuration. The coupler 820 is illustrated in a semi-cutaway manner to illustrate the adjustable coupling mechanism. The distance between the members 810, 830 may be adjusted by clamping the coupler over the hook ends of the members 810, 830 at different locations on the coupler 820. In addition, an optional cover 840 may be extended over the non-coupled sides of the attachment device.

While this invention has been described with reference to certain specific embodiments and examples, it will be recognized by those skilled in the art that many variations are possible without departing from the scope and spirit of this invention. For example, the teachings of one embodiment may be combined with the teachings of another and remain consistent with the scope and spirit of this invention. The invention, as defined by the claims, is intended to cover all changes and modifications of the invention which do not depart from the spirit of the invention. The words "including" and "having," as used in the specification, including the claims, shall have the same meaning as the word "comprising".

What is claimed is:

1. An adjustable attachment device comprising:

two threaded members, wherein the two threaded members include a threaded end and a cover end, and wherein the threaded ends of each threaded member is oppositely threaded from the threaded end of the other threaded member;

a coupler including two reverse threaded receiving portions, wherein the threaded ends of the two threaded members are capable of coupling to the receiving portions of the coupler; and a cover extending over and between the two cover ends of the two threaded members, wherein the cover is rotatably independent of the two threaded members.

2. The adjustable attachment device of claim 1, wherein the threaded ends are threaded in a male configuration and the receiving portions are threaded in a female configuration.

3. The adjustable attachment device of claim 1, wherein the two threaded members are U-shaped.

4. The adjustable attachment device of claim 1, wherein the threaded end of each of the two threaded members is finely threaded.

5. The adjustable attachment device of claim 1, wherein the threaded end of each of the two threaded members is corkscrew threaded.

6. The adjustable attachment device of claim 1, wherein the cover end of each of the two threaded members is not threaded.

7. The adjustable attachment device of claim 1, wherein the threaded members are each composed of a substantially plastic material.

8. The adjustable attachment device of claim 1, wherein the threaded members are each composed of a substantially metal material.

9. The adjustable attachment device of claim 1, wherein the coupler is shaped in a substantially cylindrical manner and wherein the two receiving portions are each disposed on opposite ends of the coupler.

10. The adjustable attachment device of claim 1, wherein the coupler is composed of a substantially plastic material.

11. The adjustable attachment device of claim 1, wherein the coupler is composed of a substantially metal material.

12. The adjustable attachment device of claim 1, wherein the cover is composed of a bendable material.

13. The adjustable attachment device of claim 1, wherein the cover substantially covers the remainder of the two threaded members that is not threaded within the coupler.

14. The adjustable attachment device of claim 1, wherein the cover is shaped in a substantially tubular manner and extends over the cover ends of the two threaded members.

15. A ski related structure comprising:

a first member comprising a first member first end for positioning adjacent to one of a top and bottom surface of a ski, a first member second end for positioning adjacent to the other of a top and bottom surface of a ski, and a first member mid-section extending between said first member first and second ends and for positioning adjacent to a first side surface of a ski that is located between top and bottom surfaces of a ski; and a second member comprising a second member first end for positioning adjacent to one of a top and bottom surface of a ski, a second member second end for positioning adjacent to the other of a top and bottom surface of a ski, a second member mid-section extending between said first member first and second ends and for positioning adjacent to a second side surface of a ski that is located opposite to said first side surface of a ski relative a longitudinal axis of a ski;

wherein said first member second end comprises a first threaded section;

wherein said second member second end comprises a first threaded portion for engaging said threaded section;

wherein when said first threaded section engages said first threaded portion, a skin engagement section is formed between said first and second member mid-sections that is capable of supporting a ski skin;

wherein when said first threaded section engages said first threaded portion, said first member mid-section is separated from said second member mid-section by a distance;

wherein when said first threaded section engages said first threaded portion, relative rotation between said first threaded section and said first threaded portion can be used to alter said distance between said first member mid-section and said second member mid-section to facilitate attachment of a ski skin to skis having different tip shapes.

16. A ski related structure, as claimed in claim 15, wherein:

said first threaded section comprises a first threaded bolt; and said first threaded portion comprises a first threaded nut.

17. A ski related structure, as claimed in claim 15, wherein:

said first threaded section comprises a first threaded nut; and said first threaded portion comprises a first threaded bolt.

18. A ski related structure, as claimed in claim 15, wherein:

said skin engagement section comprises said first and second member second ends.

19. A ski related structure, as claimed in claim 15, wherein:

said skin engagement section comprises said first and second member first ends.

20. A ski related structure, as claimed in claim 15, wherein:

said first threaded section comprises a threaded nut; and said first member second end comprises member;

wherein said threaded nut is fixedly attached to member such that said threaded nut is incapable of rotating relative to said member.

21. A ski related structure, as claimed in claim 15, wherein:

said first threaded section comprises a threaded nut; and said first member second end comprises a keeper member;

wherein said threaded nut is retained by said keeper member but free to rotate relative to said keeper member.

22. A ski related structure, as claimed in claim 15, wherein:

said first member first end comprises a recess for accommodating a portion of said second member first end.

23. A ski related structure, as claimed in claim 15, wherein:

said second member second end comprises a recess for accommodating a portion as said first member first end.

24. A ski related structure, as claimed in claim 15, further comprising:

a cover for engaging said first member first end and said second member first end;

wherein said cover is capable of engaging said first and second member first ends over a range of said distance.

25. A ski related structure, as claimed in claim 24, wherein:

said cover comprises a recess for engaging one of said first and second member first ends.

26. A ski related structure, as claimed in claim 24, wherein:

said cover comprises an end for engaging a recess in one of said first and second member first ends.

27. A ski related structure, as claimed in claim 15, further comprising:

a skin for engaging said skin engagement section.

28. A ski related structure, as claimed in claim 27, further comprising:

a ski.

29. A ski related structure, as claimed in claim 15, wherein:

said second member second end comprises a second threaded bolt and a second threaded receptacle for receiving said second threaded bolt;

wherein when said second threaded bolt engages said second threaded receptacle, relative rotation between said second threaded bolt and said second threaded receptacle can be used to alter said distance between said first member mid-section and said second member mid-section to facilitate attachment of a ski skin to skis having different tip shapes.

* * * * *